United States Patent [19]

Goud

[11] Patent Number: 5,004,065

[45] Date of Patent: Apr. 2, 1991

[54] SKI BRAKE

[75] Inventor: Gilles R. Goud, Annecy Cedex, France

[73] Assignee: Salomon S.A., Annecy Cedex, France

[21] Appl. No.: 353,757

[22] Filed: May 18, 1989

[30] Foreign Application Priority Data

May 18, 1988 [FR] France ..... 88 06651

[51] Int. Cl.[5] ..... A63C 7/10

[52] U.S. Cl. ..... 280/605; 280/609

[58] Field of Search ..... 280/605, 607, 609, 615

[56] References Cited

U.S. PATENT DOCUMENTS

| | | | |
|---|---|---|---|
| 4,239,256 | 12/1980 | Krob et al. | 280/605 |
| 4,279,432 | 7/1981 | Krob et al. | 280/605 |
| 4,453,731 | 6/1984 | Krob | 280/605 |
| 4,521,032 | 6/1985 | Hardemann | 280/605 |
| 4,573,700 | 3/1986 | Beyl et al. | 280/605 |

FOREIGN PATENT DOCUMENTS

| | | | |
|---|---|---|---|
| 0050098 | 4/1982 | European Pat. Off. | 280/605 |
| 2364673 | 4/1978 | France | 280/605 |
| 2447208 | 8/1980 | France | 280/605 |
| 2522976 | 9/1983 | France | 280/605 |
| 2526320 | 11/1983 | France | 280/605 |
| 2544211 | 10/1984 | France | 280/605 |

*Primary Examiner*—David M. Mitchell

*Attorney, Agent, or Firm*—Sandler, Greenblum & Bernstein

[57] ABSTRACT

A ski brake adapted to be mounted on a ski having a longitudinal ridge. The configuration of the surfaces of the rib control the activation of the braking elements. In the inactive position, each braking element is located in the dihedron-shaped space formed by a side of the rib and the upper edge of the ski.

7 Claims, 4 Drawing Sheets

SKI BRAKE

BACKGROUND OF THE INVENTION

1. Field of the Invention

The present invention relates to a ski brake.

2. Discussion of Background and Relevant Information

Ski brakes, which are generally mounted onto skis, to replace previously used safety straps which presented well known disadvantages, comprise, in general, two braking elements each having one stop arm ending in a "spade" adapted to be planted in the snow on each side of the ski, to immobilize the ski, when it is separated from the boot of the skier following a fall. The ski brakes generally comprise an elastic mechanism which automatically causes the braking elements to move into the active braking position in which these braking elements project under the ski upon release of the binding. They comprise a pedal connected to the braking elements, on which the ski boot rests to pivot the braking elements to an inactive position when the boot is inserted in the binding and during skiing. The braking elements are retracted vertically and laterally to be above the ski so as not to hinder skiing.

There are various known types of ski brakes of this type in which the path of the braking elements between the active braking position and the inactive position is broken down into a first part during which each braking element moves substantially in a vertical plane, i.e. perpendicular to the ski, until the braking element reaches an intermediate position, and a second part starting from this intermediate position to the inactive position in which each braking element is retracted in the direction of the longitudinal axis of the ski and above the upper surface of the ski. The effect of this is that in the inactive position during skiing, the retracted braking elements are not laterally beyond the ski and thus cannot become unwanted obstacles that rub against the snow during skiing.

Ski brakes of this type, i.e. in which the braking elements are subjected to a vertical and lateral movement, are described more particularly in French Patents Nos. 2,447,208 and 2,526,320.

Also, skis which have a longitudinal rib on their upper 5 surface which extends either along the entire length of the ski or only in the middle portion, i.e. in the area of the "middle sole" where the boot rests solidly affixed to the ski, are known.

SUMMARY OF THE INVENTION

This invention is directed to a ski brake to be mounted on a ski, the ski having on its upper part, a longitudinal rib defined by an upper surface and two sides being connected, respectively, to upper edges of the ski which extend as far as the edges of the ski, the ski brake comprising two braking elements mounted laterally with respect to the ski and being movable between an active braking position in which the braking elements project under a lower plane of the ski, and an inactive skiing position in which the braking elements are raised and located above the ski. A pedal is journalled on the ski for movement about a transverse axis, the braking elements being journalled on the pedal for movement about an axis from the active braking position to the inactive position when a ski boot is inserted, an elastic mechanism for biasing the pedal and the braking elements towards the active braking position, and retraction means for moving each of the braking elements towards the interior of the ski during the last portion of the pivoting path of the brake between an intermediate position and the inactive position. The retraction means of each braking element comprises a support ramp and an activation member movably mounted on the pedal for cooperating with the support ramp when the pedal approaches the ski, the activation member being connected to the braking element so as to pivot the braking element, about its respective axis, in the direction of the interior of ski.

When the braking elements are in the inactive position, each braking element is located in the dihedron-shaped space formed by a side of the rib and the upper edge of the ski to which the side is connected.

The support ramp can be formed either by a surface of the rib or an upper edge of the ski.

Each braking element comprises a stop arm which is journalled for movement about an axis perpendicular to the plane of the pedal. The activation element comprises a beveled edge which is inclined from bottom to top and from the exterior towards the interior of the ski. The beveled edge cooperates with one of the sides of the rib. According to another aspect of the invention, the beveled edge cooperates with a wedge that is slidably mounted perpendicular to the plane of the pedal. The wedge can also be lodged in a hole bored in a counter-plate fixed solidly to a small upper plate of pedal beneath the extreme upper part of arm.

Each braking element comprises a stop arm having along its internal side and beneath its journal axis, a cutout forming a small elastic tongue which forms a flexion leaf spring adapted to rest against an element that is fixed under the pedal.

In another aspect of the invention, each braking element comprises a stop arm mounted for pivoting about an axis contained in the plane of the pedal and in a vertical and longitudinal plane, and wherein the activation member is mounted at the upper end of the stop arm. The activation member of the stop arm comprises an extreme upper part which is bent so as to extend in a transverse plane from bottom to top and from the exterior towards the interior of the ski in the active braking position, so as to be pushed upwardly when it comes into contact with a corresponding edge of the ski during the lowering movement of the pedal on the ski.

The activation element can also comprise a cam fixed solidly to the stop arm and which rests on an inclined side of the rib, to cause the rotation of the stop arm during lowering movement of the stop arm on the ski.

In another aspect of the invention, the activation element comprises an activation wedge which is slidably mounted in a horizontal transverse hole bored in a corresponding lower lateral wall of the pedal. The wedge projects towards the exterior of the ski where it comes into contact with a portion of the stop arm. The wedge projects into the interior in a lower central opening formed between two lower lateral walls of the pedal, the wedge includes a beveled surface for coming into contact, with the rib, when the pedal moves toward the ski. The wedge comes into contact with the rib at the junction of the upper surface and a corresponding side of the rib.

BRIEF DESCRIPTION OF THE DRAWINGS

Various embodiments of the present invention will be described below by way of non-limiting examples, in reference to the drawings wherein.

DETAILED DESCRIPTION OF THE PREFERRED EMBODIMENTS

The present invention relates to a ski brake adapted for mounting on the type of ski having a longitudinal rib and makes use of the configuration of the surfaces of the rib to control the activation of the braking elements and also creates extra thickness in the inactive position, when the brake pedal rests on the longitudinal rib.

To this end, the ski brake is mounted on a ski having, on its upper portion, a longitudinal rib defined by an upper surface and two sides attached, respectively, to upper edges of the ski and extending as far as the edges of the ski. The ski brake comprises two braking members mounted laterally with respect to the ski and are movable between an active braking position in which the braking members project under the lower plane of the ski, and an inactive position during skiing in which the braking members are raised and are located above the ski. A pedal is journalled on the ski for movement about a transverse axis and is connected to each braking element, each of which is journalled on the pedal for movement about an axis to make them move from the active braking position to the inactive position under the action of the ski boot during the insertion of the boot. An elastic mechanism biases the pedal and the braking members towards the active braking position. Retraction means on each braking member moves them towards the interior of the ski during the last part of the path of the brake's pivoting between an intermediate position and the inactive position. The retraction means of each braking element comprise, in combination, a support ramp formed by a surface of the rib or an upper edge of the ski and an activation element movably mounted on the pedal, cooperating with the support ramp at the end of the path of the pedal on the ski and is connected to the braking member so as to then cause pivoting of the braking member, around its respective axis in the direction of the interior of the ski.

According to another aspect of the invention, in the inactive position, each braking element is set in the dihedron-shaped space formed by a side of the rib and the upper edge of the ski to which it is attached.

Figure 1:
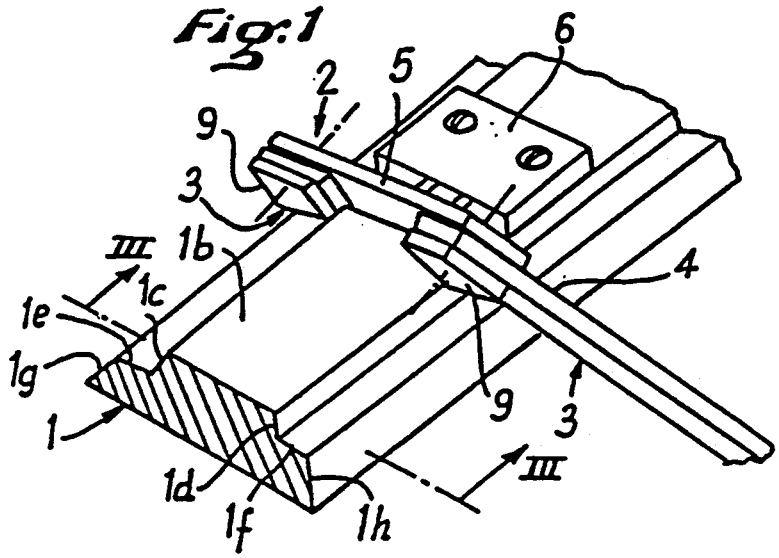
FIG. 1 is a perspective view of a ski brake mounted on a ski having an upper longitudinal rib, and shown in the active braking position.
Figure 2:
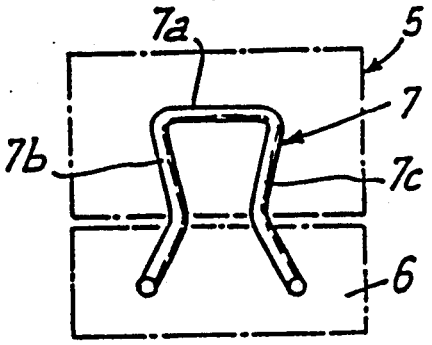
FIG. 2 is an schematic view of the energization mechanism of the brake pedal.
Figure 3:
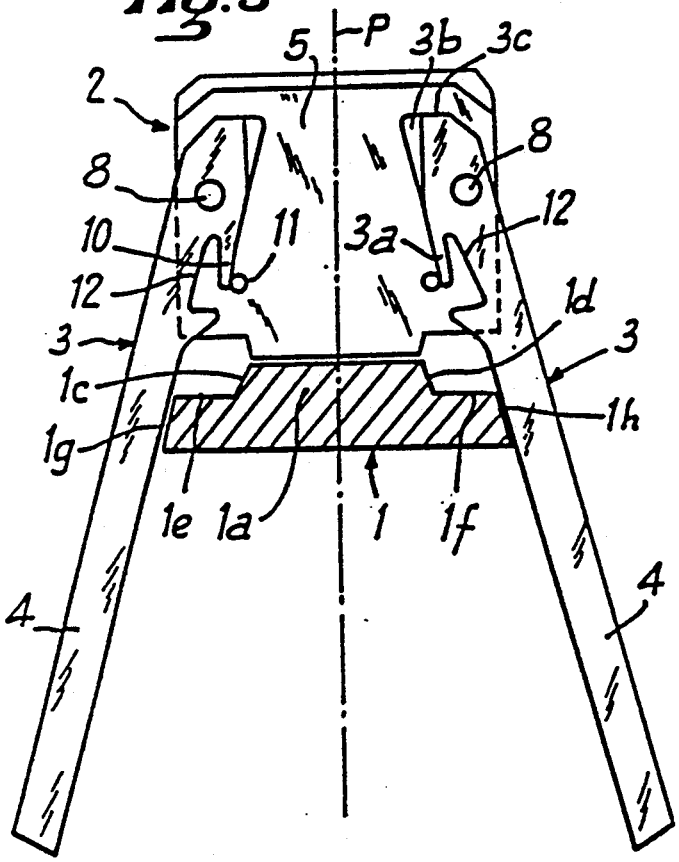
FIG. 3 is a vertical and transverse cross-sectional view taken along line III—III of FIG. 1.
Figure 4:
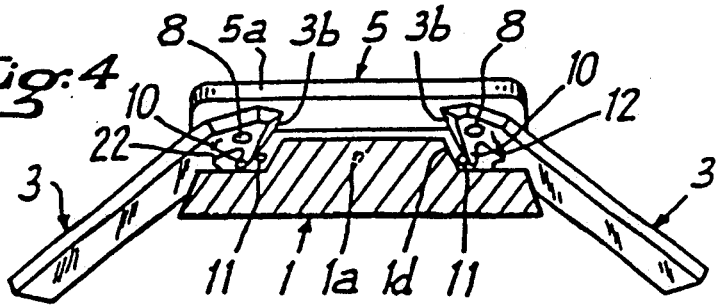
FIG. 4 is a vertical and transverse cross-sectional view similar to that of FIG. 3, showing the path of the brake in the direction towards its inactive position, just before the intermediate position is attained.
Figure 6:
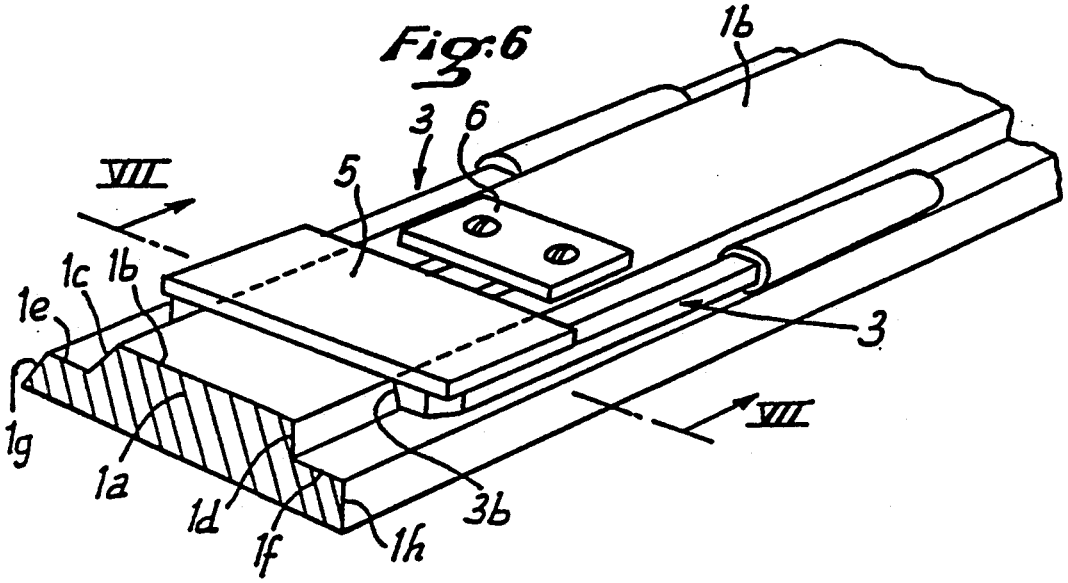
FIG. 6 is a perspective view of the ski brake in the inactive position.

The ski brake according to the invention shown in FIGS. 1–7 is mounted on a ski 1 and is designated in its entirety by reference number 2. The ski brake comprises essentially two braking members 3 which are positioned laterally and on each side of the ski, and which are adapted to be planted in the snow when the brake is in the active braking position as is shown in FIGS. 1, 3 and 4, i.e. when the ski boot is not connected to the ski 1. Each of the braking members comprises a stop arm 3 having an extreme lower portion forming a "spade", which is preferably constructed of a plastic material, and which is shaped so as to be easily sunk into the snow. The two stop arms 3 are connected at their upper ends to a pedal 5 which is connected by an energization biasing mechanism 7 to base 6 which is affixed solidly to the ski. The base can be affixed solidly on the upper surface of the ski by means of a screw or by any other appropriate means to permit a longitudinal displacement of the base 6 on the ski. The base 6 can be locked in an adjustable longitudinal position on a slide affixed to the ski that supports a safety binding, or it can be fastened to a rear binding, etc.

Pedal 5 is biased upwardly, i.e. towards the active braking position, by elastic energization mechanism 7 of any appropriate type. In the embodiment shown in FIG. 2, the mechanism 7 comprises a deformable energization loop positioned so that its upper horizontal and transverse core 7*a* rests under the central zone of the pedal 5. The loop 7 also comprises two branches 7*b*, 7*c* converging downwardly slightly towards one another and is completed by outer section members fixed in the base 6 which affixed solidly to the ski 1 (see French Patent No. 2,526,320). The deformable loop 7 assures both the return of the pedal 5 to its active braking position and the journalling of the pedal 5 with respect to the base 6. In the active braking position the pedal 5, as well as the stop arms 3 are inclined with respect to a horizontal line, preferably from top to bottom and from front to rear.

The ski brake 2 is mounted, as can be seen in the drawings, on a ski 1 which includes longitudinal rib 1*a* on its upper surface. This rib can extend along substantially the entire length of the ski or it can be limited to the support zone of the boot to be mounted on the ski. This upper longitudinal rib 1*a* is defined by an upper horizontal surface 1*b* and two sides or lateral surfaces 1*c*, 1*d*. These two sides can be inclined so as to converge upwardly as is shown in FIGS. 1 and 3, in which case the upper longitudinal rib 1*a* has a trapezoidal transverse cross-section, or they can both be vertical, in which case the rib 1*a* has then a rectangular transverse cross-section. The two sides 1*c*, 1*d* of the rib 1*a* are attached respectively, to the upper edges 1*e*, 1*f* of the ski. The edges can be horizontal or slightly inclined towards the bottom. These edges 1*e*, 1*f* extend respectively, as far as the sides 1*g*, 1*h* of the ski 1. The sides can be vertical or can slightly converge upwardly as shown in FIGS. 1 and 3.

According to the invention, the particular profile of the ski 1 and the longitudinal rib 1*a* lowers to the maximum the level at which the upper surface of the pedal 5 is located when it extends horizontally flat on the ski, when the boot is in the insertion position, and contributes to the retraction movement of the stop arms 3 in the direction of the vertical and longitudinal plane of symmetry P of the ski, during the brake's passage into inactive position.

As can be seen more particularly in FIGS. 1 and 3, each of the stop arms 3 is journalled at its extreme upper part under the pedal 5, for movement about a respective pivoting axis 8 perpendicular to the plane of the pedal. Preferably at this location, the extreme upper part of each arm 3 is wedged between the small upper plate 5*a* of the pedal 5 and a counter-plate 9 that is fixed laterally under the small plate 5*a* (FIG. 1). Each axis 8 is fixed, respectively, at its two ends to the pedal 5 and to the counter-plate 9.

Each stop arm 3 is elastically biased by an energization device which tends to push the arm 3 and consequently its spade 4 towards the exterior of the ski. This energization device, which is totally independent of 5 the energization mechanism 7 of pedal 5, comprises a spring which extends from a fixed point of the pedal 5 and which acts on the upper part of the arm 3. This spring can be a leaf spring fastened to the upper end of arm 3 above the pivoting axis 8, and biasing this end in the direction of the longitudinal and vertical plane P. The spring can also be a torsion spring or a compression or flexion spring acting on a part of the arm 3 situated under the pivoting axis. The spring preferably comprises one elastic leaf 10 which is solid with the extreme upper part of each arm 3 and the end of which rests against a fixed piece 11 under the pedal 5. The leaf of spring 10 of each arm 3 can be formed by an elastic leaf fixed to arm 3. However, it is preferably formed by a small tongue created by the formation cutout extends beneath the pivoting axis 8. Because of the presence of the cutout 12, the small tongue 10 forms a flexion leaf spring and it deforms elastically by accumulating energy when each stop arm 3 pivots around the axis 8 in the direction of the vertical and longitudinal plane of symmetry P of the ski.

Furthermore, each arm 3 has at its extreme upper end, which is situated above its pivoting axis 8, a beveled edge 3*b* which extends along its internal edge 3*a* and which is inclined from bottom to top and from the exterior towards the interior. The beveled edge 3*b* is adapted to cooperate directly, in this embodiment, with a support ramp which is formed by one of the inclined sides 1*c*, 1*d* of the rib 1*a* of ski 1, at the end of the insertion movement, to cause the retraction of the two stop arms 3 in the direction of plane P, in opposition to the action of the small elastic tongues 10.

Figure 5:
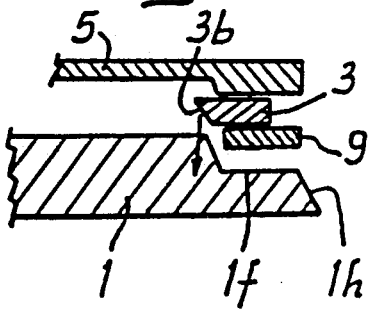
FIG. 5 is a partial vertical and transverse cross-sectional view in the area of the beveled edge provided at the end of each stop arm.
Figure 7:
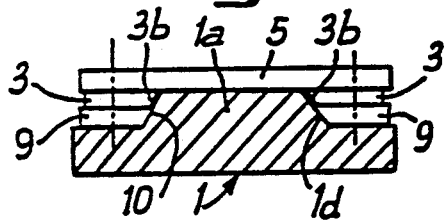
FIG. 7 is a vertical and transverse cross-sectional view taken along line VII—VII of FIG. 6.

When the skier puts on his ski, he steps with his boot on the pedal 5 of the ski brake 2, thereby pivoting the pedal assembly and the two stop arms 3 in opposition to the return action of the energization loop 7, and around the transverse pivoting axis defined in base 6 by the placement of the extreme section members of the deformable loop 7. In the course of this pivoting movement the two stop arms 3 reach, at a certain time, an intermediate position which is almost horizontal. At this moment the upper beveled edges 3*b* of the two arms 3 come into contact with the inclined sides 1*c*, 1*d* which forms support ramps on the rib 1*a* of the ski 1 (FIG. 5). The action of the movement of the pedal 5 in the direction of the ski causes the two beveled edges 3*b* to slide, respectively, on the sides 1*c*, 1*d*, the beveled edges thus being pushed progressively by the inclined sides towards the exterior of the ski. As a result, the two stop arms 3 pivot around their respective axes 8 and retract toward plane P. At the moment when this retraction movement takes place, the two stop arms 3 are located slightly above the horizontal edges 1*e*, 1*f* of the ski and as a result, when the pedal 5 is applied flat on the upper horizontal surface 1*b* of the rib 1*a*, the two stop arms 3 are lodged within the two dihedron-shaped spaces defined, respectively, by the sides 1*c*, 1*d* and the horizontal edges 1*e*, 1*f* as is shown in FIG. 7. It can be seen in this figure that the upper surface of the pedal 5, which is then flat on the upper surface 1*b* of the rib 1*a*, slightly projects with respect to the upper surface 1*b* of rib 1*a*. The extra thickness corresponds in fact only to the thickness of the upper small plate 5*a* of pedal 5, since the rib 1*a* is totally located in the central open space formed beneath small plate 5*a* and between the two lateral counter-plates 9. Furthermore, the two stop arms 3 are also totally retracted beneath the plane of the upper surface 1*b* of rib 1*a*. As a result, the stop arms 3 are totally located within the perimeter of the entire ski 1, thereby decreasing the risk of catching these arms on obstacles during skiing.

When the boot is separated from the ski by voluntary removal or a fall, the deformable loop 7 biases the pedal 5 back into the upwardly inclined position as shown in FIGS. 1 and 3. In the course of the first phase of this movement from the inactive position to the intermediate position, the beveled edges 3*b* of arms 3 which are pushed into contact with sides 1*c*, 1*d* by the small elastic tongues 10, slide on these sides 1*c*, 1*d* and the arms 3 then pivot slightly towards the exterior of the ski about their axes 8 under the action of the small elastic tongues 10. After going beyond the intermediate position, the beveled edges 3*b* pass above the upper surface 1*b* of rib 1*a*. They are then freed and the small elastic tongues 10 which are then compressed against the energization elements 11, expand and push the stop arms 3 towards the exterior of the ski and into the active braking position. As a result, the stop arms 3 are separated from one another, as viewed longitudinally, when the ski brake is in the active braking position as shown in FIG. 3.

Figure 9:
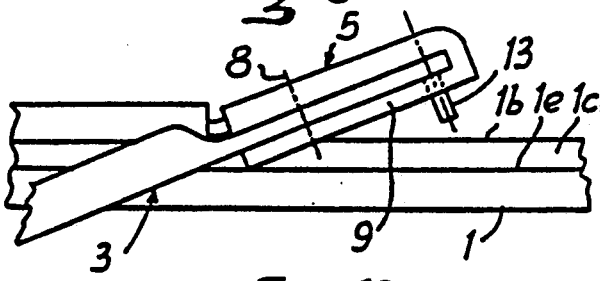
FIG. 9 is a partial elevated view of an alternative embodiment of the ski brake, shown in the active braking position.
Figure 8:
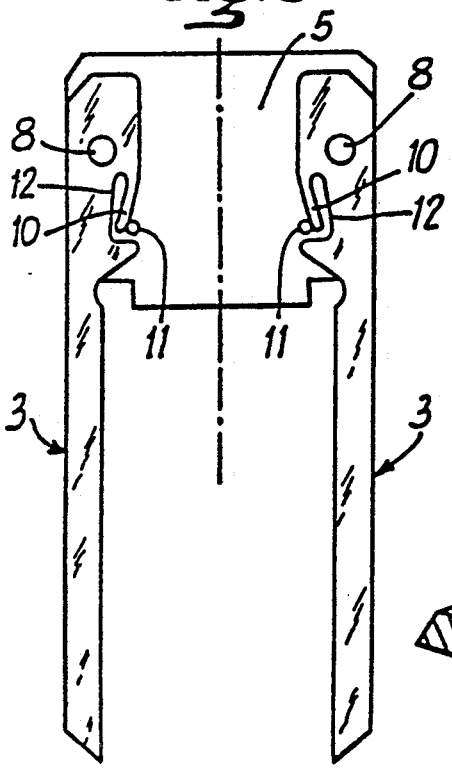
FIG. 8 is a bottom view of the ski brake pedal, the stop arms being shown in the inactive position.
Figure 10:
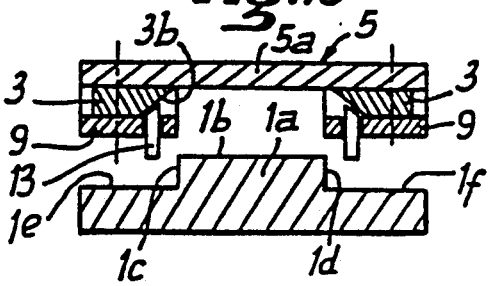
FIG. 10 is a transverse cross-sectional view taken along line X—X of FIG. 9.

In the alternative embodiment shown in FIGS. 9 and 10, the upper rib 1*a* of ski 1 has sides 1*c*, 1*d* which are vertical and it has thus a transverse rectangular section. However, it could also have a trapezoidal transverse section as in the embodiment of FIGS. 1–8 previously described. Furthermore, each arm 3 has a beveled edge 3*b* at its extreme upper part and along its inside edge, which is inclined from bottom to top and from the exterior towards the interior, i.e. in the direction of plane P. Under this beveled edge 3*b* is positioned a wedge 13 that is slidably mounted perpendicular to the plane of pedal 5. This wedge can be lodged in a hole bored for this purpose in the counter-plate 9 that is fixed solidly to the small upper plate 5*a* of pedal 5 beneath the extreme upper part of arm 3. With this arrangement, when pedal 5 is supported on the ski at the moment of insertion of the boot, the lower end of each wedge 13 rests on one of edges 1*e*, 1*f* of the ski and as a result it is pushed upwardly. Its upper end is then pushed against and slides along the inclined beveled edge 3*b*. This beveled edge forms a ramp which pushes the beveled edges toward the exterior of the ski, which pivots the corresponding arm 3 around its axis 8 in the direction of the vertical and longitudinal plane P.

Figure 11:
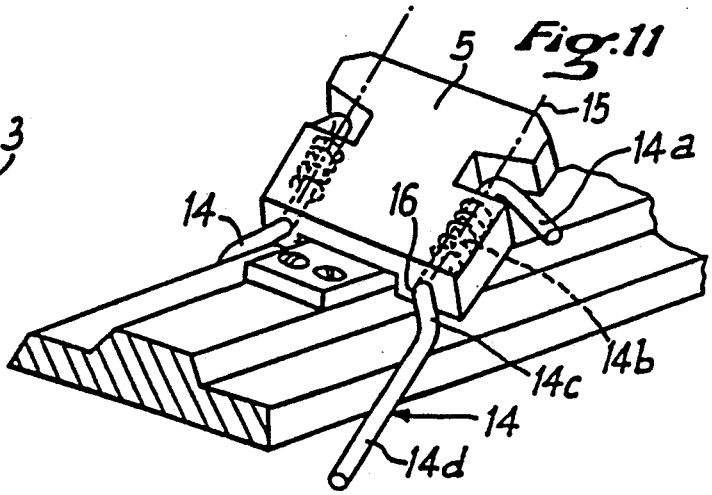
FIG. 11 is a perspective view of another embodiment of the ski brake, shown in the active braking position.
Figure 12:
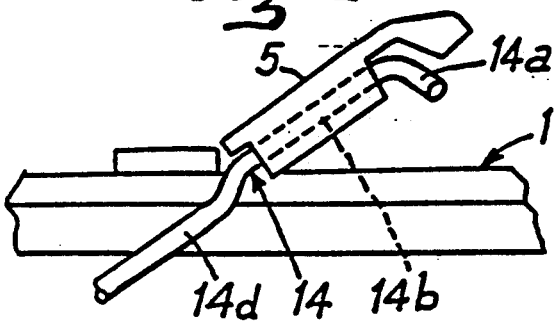
FIG. 12 is a partial elevated view of the ski brake of FIG. 11.
Figure 13:
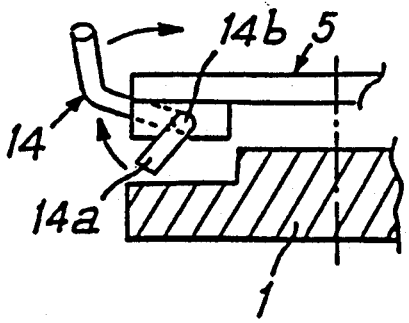
FIG. 13 is a partial vertical and transverse cross-sectional view of the ski brake of FIG. 11 in the position it occupies just before the retraction of the stop arms takes place.

In the alternative embodiment of the invention shown in FIGS. 11–14, each stop arm 14 is mounted for pivoting about an axis 15 contained in a vertical and longitudinal plane within the plane of pedal 5. Each stop arm 14 comprises an extreme upper part 14*a* which is bent so as to extend, in a transverse plane from bottom to top and from the exterior towards the interior in the direction of plane P when it is in the active braking position as shown in FIGS. 11 and 12. This extreme part 14*a* is connected to an intermediate section member 14*b*, bent substantially 90° with respect to the extreme part 14*a* and which extends through a longitudinal hole 16 along axis 15 in a marginal portion of pedal 5 and forms a bearing for the stop arm 14. This arm then comprises a bent intermediate part 14*c* and a lower part 14*d* ending in the actual braking spade. In this embodiment, each stop arm 14 is provided with a return spring 17 which biases the arm 14 so as to separate the spade from the ski. The spring 17 can be, for example, a torsion spring which is wound around the intermediate section member 14*b* in pedal 5.

With the embodiment of the invention shown in FIGS. 11–14, when pedal 5 is lowered onto ski 1, during the insertion of the boot, the extreme bent part 14*a* of each arm 14 comes into contact with the corresponding edge 1*e*, 1*f* and during the descending movement of pedal 5, it is pushed upwardly, which translates into rotation of the arm assembly 14 about its axis 15 which is defined by its intermediate section member 14*b* lodged in hole 16. With this rotation, the lower part 14*d* of each stop arm 14 which ends in the spade, is retracted in each of the dihedron-shaped spaces formed by the sides 1*c*, 1*d* and the edges 1*e*, 1*f*.

Figure 14:
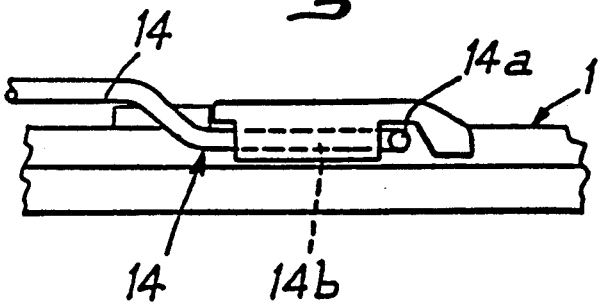
FIG. 14 is a partial elevated view of the ski brake of FIG. 11 in the inactive position.

In this embodiment, so that pedal 5, when it is flat on the rib 1*a* of the ski 1, entails the least possible extra thickness, the pedal 5 is hollowed out in its lower surface, so as to be able to overlap rib 1*a* when in the inactive position, as is shown in FIG. 14.

Figure 15:
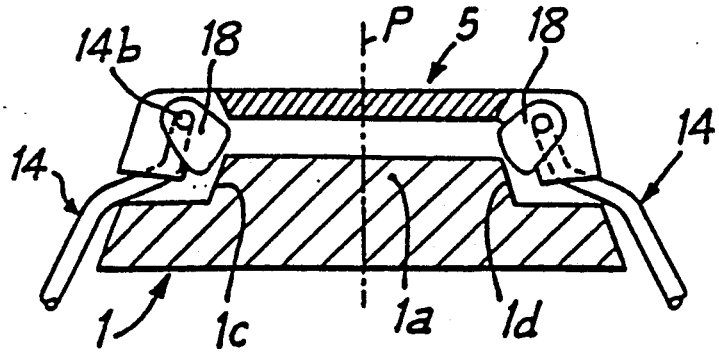
FIGS. 15 and 16 are vertical and transverse cross-sectional views of another embodiment of the ski brake, shown in the active braking position and inactive position, respectively.
Figure 16:
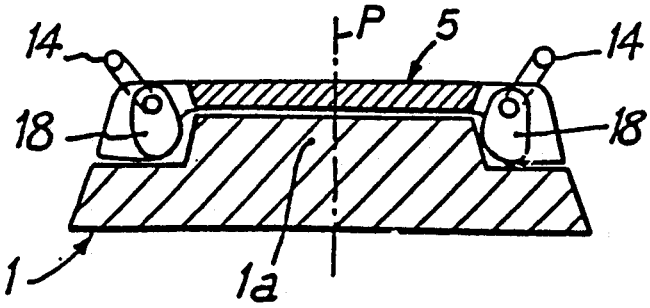

In the embodiment shown in FIGS. 15 and 16, the ski brake is similar to that illustrated in FIGS. 11–14. The stop arms 14 support, at their upper ends, cams 18 fixed solidly to intermediate section members 14*b* which form axes of rotation. These cams 18 are intended to rest on the inclined sides 1*c*, 1*d* of rib 1*a* to cause the rotation of the stop arms 14 and their retraction into the retracted position when the ski brake is placed in the inactive position.

Figure 17:
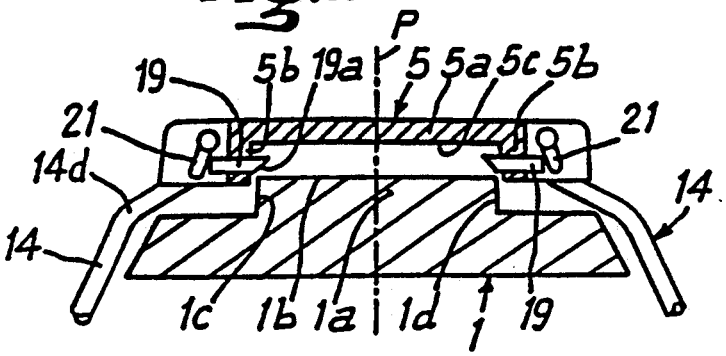
FIGS. 17 and 18 are vertical and transverse cross-sectional vies of still another embodiment of the ski brake, shown in the active braking position and inactive position, respectively.
Figure 18:
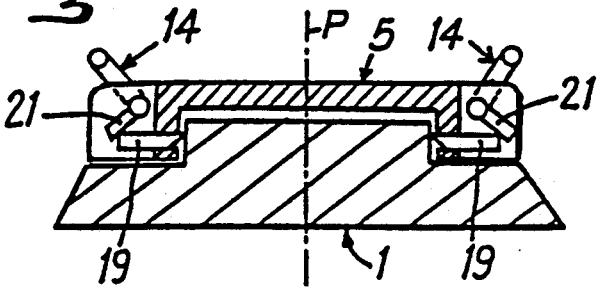

In the embodiment shown in FIGS. 17 and 18, the pedal 5 supports an activation wedge 19 for each arm 14, which is slidably mounted in a horizontal and transverse hole bored in a corresponding lateral lower wall 5*b* of pedal 5. The wedge 19 projects towards the exterior of the ski and it is at this position in contact with a radial arm 21 solidly fixed to the stop arm 14 or with a corresponding bent part of the arm. The wedge 19 also projects inside the central lower opening 5*c* formed between the two lower lateral walls 5*b* of pedal 5. At this point, it has an extreme beveled surface 19*a* which is inclined from bottom to top and from the exterior towards the interior of the ski, i.e. in the direction of plane P. The beveled surface 19*a* is adapted to come in contact with the rib formed at the junction of the upper horizontal surface 1*b* of rib 1*a* and of the corresponding side 1*c*, 1*d* when the pedal 5 is flat on the ski. Consequently, when pedal 5 is lowered onto the ski, each wedge 19 is pushed towards the exterior of the ski. This causes rotation of the stop arm 14 and its retraction along the two sides of rib 1*a*. Again, in the inactive position the rib 1*a* is engaged in the central opening 5*c* of pedal 5.

Figure 19:
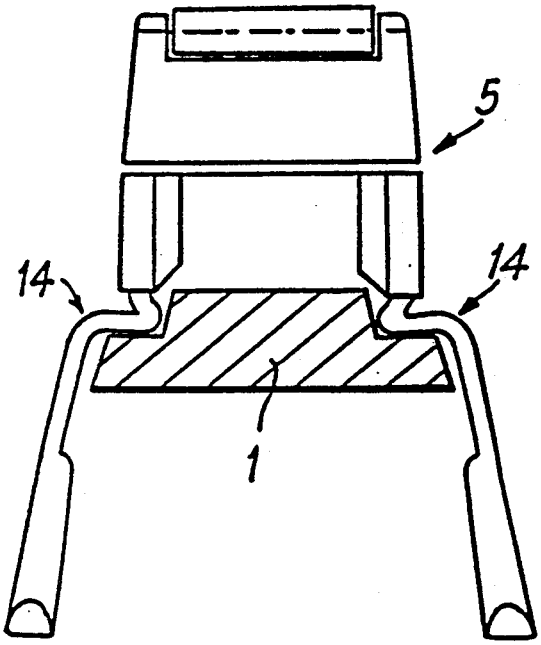
FIG. 19 is a front view of still another embodiment of a ski brake having a pedal in two parts, and shown in the active braking position.
Figure 20:
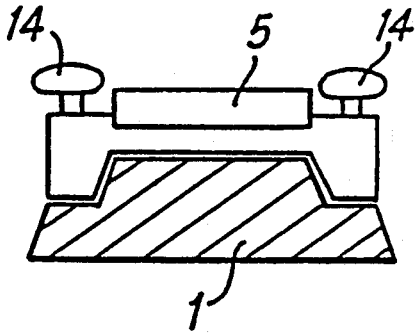
FIG. 20 is a front view of the ski brake of FIG. 19 shown in the inactive position flat on the ski.
Figure 21:
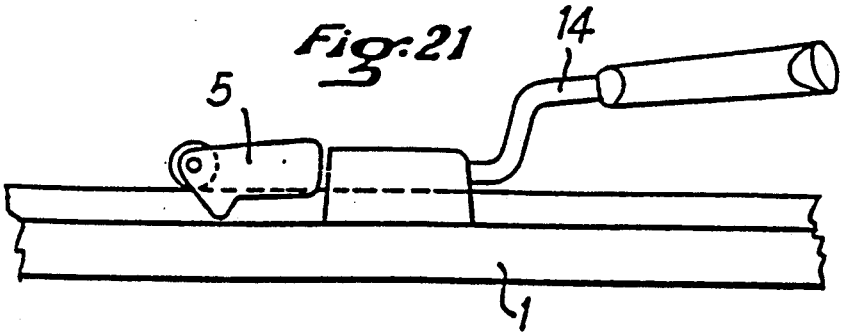
FIG. 21 is an elevated view of the ski brake of FIG. 19 shown in the inactive position.

In the embodiment shown in FIGS. 19–21, the ski brake is of the type described in French patent FR-A-2,544,211. In this case, each stop arm 14 is movable by rotation around an axis situated in the plane of pedal 5. This pedal is formed by two parts. During insertion, the boot forces the two parts of pedal 5 to go back into alignment with one another, which causes, concurrently, the retraction of the stop arms by rotation around the axes of arms 14 included in the plane of the pedal.

In all of the embodiments of the invention in which the retraction means of the braking elements comprise a lateral, vertical or inclined surface 1*c*, 1*d*, as is shown in FIGS. 1, 15 and 17, the energy necessary to generate the retraction of the braking elements brings about reaction forces whose predominant component is transverse and horizontal. In other words, the vertical reaction component which is generated by the retraction is non-existent in the case where the lateral surfaces 1*c*, 1*d* are vertical or even slight in the case where these lateral surfaces are inclined. This constitutes a particularly advantageous characteristic because this vertical component is transmitted by the pedal to the sole of the boot which transmits it in turn to the jaw of the binding in the form of a parasitic force. Thus, with the ski brake according to the invention the insertion is easier because the additional energy necessary to flatten the pedal against the ski and to cause the retraction of the braking elements is slight or even non-existent. In addition, the jaw is less disturbed in its operation by the brake return force against the sole of the boot.

Finally, although the invention has been described with reference to particular means, materials and embodiments, it is to be understood that the invention is not limited to the particulars disclosed and extends to all equivalents within the scope of the claims.

I claim:

1. Ski brake to be mounted on a ski, said ski having on its upper part, a longitudinal rib defined by an upper surface and two sides being connected, respectively, to upper edges of the ski which extend as far as the side edges of the ski, the ski brake comprising two braking elements mounted laterally with respect to the ski and being movable between an active braking position in which the braking elements project under a lower plane of the ski, and an inactive skiing position in which the braking elements are raised and located above the upper edges of the ski, a pedal journalled on the ski for movement about a transverse axis, said braking element being journalled on the pedal for movement about a journal axis from the active braking position past intermediate position to the inactive position when a ski boot is inserted, an elastic mechanism for biasing the pedal and the braking elements towards the active braking position, and retraction means for moving each said braking element towards the interior of the ski during the last portion of the pivoting path of the brake between the intermediate position and the inactive position, said retraction means of each braking element comprising a support ramp and an activation member mounted on the pedal for cooperating with said support ramp when the pedal approaches the ski, said support ramp being formed by a surface of the rib, said activation member being connected to the braking element so as to pivot the braking element, about its respective axis, in the direction of the interior of ski, said pedal overlying the upper surface of the rib when the brake elements are in the inactive position.

2. Ski brake according to claim 1 wherein, when said braking elements are in the inactive position, each braking element is located in the dihedron-shaped space formed by a side of the rib and the upper edge of the ski to which said side is connected.

3. Ski brake according to claim 1, wherein each braking element comprises a stop arm which is journalled for movement about an axis perpendicular to the plane of the pedal, and wherein said activation member comprises a beveled edge which is inclined from bottom to top and from the exterior towards the interior of the ski, said beveled edge cooperating with said support ramp.

4. Ski brake according to claim 3, wherein said beveled edge cooperates with one of the sides of the rib.

5. Ski brake according to claim 1, comprising an element fixed under said pedal, and wherein each braking element comprises a stop arm having along its internal side and adjacent said journal axis, a cutout formed a small elastic tongue which forms a flexion leaf spring adapted to rest against said element that is fixed under said pedal.

6. Ski brake to be mounted on a ski, said ski having on its upper part, a longitudinal rib defined by an upper surface and two sides being connected, respectively, to upper edges of the ski which extend as far as the side edges of the ski, the ski brake comprising two braking elements mounted laterally with respect to the ski and being movable between an active braking position in which the braking elements project under a lower plane of the ski, and an inactive skiing position in which the braking elements are raised and located above the ski, a pedal journalled on the ski for movement about a transverse axis, said braking elements being journalled on the pedal for movement about a journal axis from the active braking position past an intermediate position to the inactive position when a ski boot is inserted, an elastic mechanism for biasing the pedal and the braking elements towards the active braking position, and retraction means for moving each said braking element towards the interior of the ski during the last portion of the pivoting path of the brake between the intermediate position and the inactive position, said retraction means of each braking element comprising a support ramp and an activation member mounted on the pedal for cooperating with said support ramp when the pedal approaches the ski, said activation member being connected to the braking element so as to pivot the braking element, about its respective axis, in the direction of the interior of ski, an element being fixed under said pedal, wherein each braking element comprises a stop arm having along its internal side and adjacent said journal axis, a cutout forming a small elastic tongue which forms a flexion leaf spring adapted to rest against said element that is fixed under said pedal.

7. Ski brake according to claim 6, wherein said support ramp is formed by a surface of the rib.

* * * * *